US006052054A

United States Patent [19]

Hampson et al.

[11] Patent Number: 6,052,054

[45] Date of Patent: Apr. 18, 2000

[54] PORTABLE SCOREBOARD SYSTEM WITH MOTION SENSING FOR PROVIDING THEFT PREVENTION

[76] Inventors: Derek J. Hampson; Craig Witcraft, both of 100 Terrace Dr., Mundelein, Ill. 60060

[21] Appl. No.: 09/097,831

[22] Filed: Jun. 16, 1998

[51] Int. Cl.[7] ..... G08B 13/14

[52] U.S. Cl. ..... 340/568.1; 323/815.4 R; 323/571; 323/686.1; 323/689

[58] Field of Search ..... 340/568.1, 323 R, 340/815.4, 815.47, 815.53, 571, 540, 689, 693.1, 686.1; 116/222; 377/5; 345/2, 59, 73, 212, 211; 968/961

[56] References Cited

U.S. PATENT DOCUMENTS

| | | | |
|---|---|---|---|
| 3,638,215 | 1/1972 | Payne | 345/156 |
| 3,683,357 | 8/1972 | Presnick et al. | 340/323 R |
| 3,727,213 | 4/1973 | Kurtenbach | 340/323 R |
| 3,981,002 | 9/1976 | Gardner | 345/2 |
| 4,045,788 | 8/1977 | Castelli et al. | 340/323 R |
| 4,097,855 | 6/1978 | Salvo | 340/323 R |
| 4,237,372 | 12/1980 | Zeugolis et al. | 377/5 |
| 4,263,736 | 4/1981 | Beierwaltes et al. | 40/452 |
| 5,025,748 | 6/1991 | Pettis | 116/222 |
| 5,294,913 | 3/1994 | Mower et al. | 340/323 R |
| 5,467,076 | 11/1995 | Ruocco et al. | 340/571 |
| 5,574,422 | 11/1996 | Martin | 340/323 R |
| 5,757,271 | 5/1998 | Andrews | 340/568.1 |

*Primary Examiner*—Benjamin C. Lee
*Attorney, Agent, or Firm*—Flanagan & Flanagan; John K. Flanagan; John R. Flanagan

[57] ABSTRACT

A portable scoreboard system has motion sensing capability for providing theft protection. The system includes a main scoreboard and a remote control device. The main scoreboard includes a housing, a display panel configured to show predetermined parameters of one or more sporting events, a main microcontroller operating the display panel, a motion sensor unit responsive to movement of the scoreboard by sending an activation signal to the main microcontroller, an alarm operated by the main microcontroller and made to sound upon the main microcontroller receiving the signal from the motion sensor unit, and an RF receiver and antenna connected to the main microcontroller. The remote control device includes a casing, remote microcontroller, keypad for entering information related to the parameters of the selected sporting event to the remote microcontroller and determining the parameters displayed on the display panel of the main scoreboard, and an RF transmitter and antenna for receiving a signal from the remote microcontroller and for transmitting a remote signal to the RF receiver and antenna of the main scoreboard such that the main scoreboard is thereby operated by a user using the keypad of the remote control device.

20 Claims, 2 Drawing Sheets

PORTABLE SCOREBOARD SYSTEM WITH MOTION SENSING FOR PROVIDING THEFT PREVENTION

BACKGROUND OF THE INVENTION

1. Field of the Invention

The present invention generally relates to devices for scoring athletic events and, more particularly, is concerned with a portable scoreboard system having motion sensing capability for providing protection against theft.

2. Description of the Prior Art

Many sporting events involve keeping a score between opponents. Children and adults participate in a variety of athletic activities where a score is kept but is not displayed for all participants and spectators to view. A scoreboard is a means by which everyone can view the score of an event. As is the case with many organized sporting events at the collegiate and professional level, the scoreboard can be an integral part of the activity. Scoreboards, however, can be cumbersome and therefore difficult to move from place to place. For this reason, various portable scoreboards have been developed over the years for use at sporting events where a score would not otherwise be displayed.

Representative examples of portable scoreboards and the like are disclosed in U.S. Pat. No. 3,638,215 to Payne, U.S. Pat. No. 3,683,357 to Presnick et al., U.S. Pat. No. 3,727,213 to Kurtenbach, U.S. Pat. No. 3,981,002 to Gardner, U.S. Pat. No. 4,045,788 to Castelli et al., U.S. Pat. No. 4,097,855 to Salvo, U.S. Pat. No. 4,237,372 to Zevgolis et al., U.S. Pat. No. 4,263,736 to Beierwaltes et al., U.S. Pat. No. 5,294,913 to Mower et al. and U.S. Pat. No. 5,574,422 to Martin. While these prior art scoreboards appear to be satisfactory in use for the specific purposes for which they were designed, portability has created a new problem in that a portable scoreboard may be easily stolen. None of the prior art scoreboards appear to have specific features which are designed toward preventing theft of the scoreboard.

Consequently, a need still exists for a portable scoreboard which overcomes the aforementioned need by being adapted to aid in the prevention of theft of the scoreboard and by doing so without introducing any new problems in place thereof.

SUMMARY OF THE INVENTION

The present invention provides a portable scoreboard system designed to satisfy the aforementioned need. The portable scoreboard system of the present invention has a motion sensing capability to aid in the prevention of theft of a main scoreboard of the system. The motion sensing capability of the scoreboard system takes the form of a motion sensor unit responsive to movement of the main scoreboard by sending an activation signal to a main microcontroller of the system. The main scoreboard further involves an alarm generating means operated by the main microcontroller to produce an audible sound upon the main microcontroller receiving the activation signal from the motion sensor unit.

Accordingly, the present invention is directed to a portable scoreboard system which comprises: (a) a main scoreboard operable for displaying a score and having alarm means operable for generating an alerting output and a motion sensor unit operable in response to movement of the main scoreboard to cause the alarm means to generate the alerting output; and (b) a remote control device for controlling operation of the main scoreboard and motion sensor unit. The main scoreboard includes a scoreboard housing, a display panel mounted to the scoreboard housing and configured to show predetermined parameters of one or more sporting events, and a main microcontroller mounted to the first housing and connected to the display panel and being operable to control the parameters shown on the display panel. The motion sensor unit is mounted to the scoreboard housing and responses to movement of the scoreboard housing by sending an activation signal to the microcontroller. The alarm generating means is mounted to the scoreboard housing and operated by the main microcomputer to emit the alerting output upon the main microcontroller receiving the activation signal from the motion sensor unit. Also, the main scoreboard includes an RF receiver and antenna mounted ot the scoreboard housing and connected to the main microcontroller for receiving control signals from the remote control device and for communicating the control signals to the main microcontroller.

The remote control device of the system includes a casing, a remote microcontroller mounted to the casing for generating output signals for instructing the main microcontroller in determining the parameters displayed on the display panel of the main scoreboard, and means, such as a keypad, mounted to the casing for entering information related to the parameters of a selected one of the sporting events in the remote microcontroller for determining the output signals generated by the remote microcontroller. Also, an RF transmitter and antenna is mounted to the casing and connected to the remote microcontroller for receiving output signals generated from the remote microcontroller and transmitting a remote signal to the RF receiving and antenna of the main scoreboard and therefrom to the main microcontroller of the main scoreboard such that the main microcontroller is thereby instructed in determining parameters displayed on the display panel of the main scoreboard.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
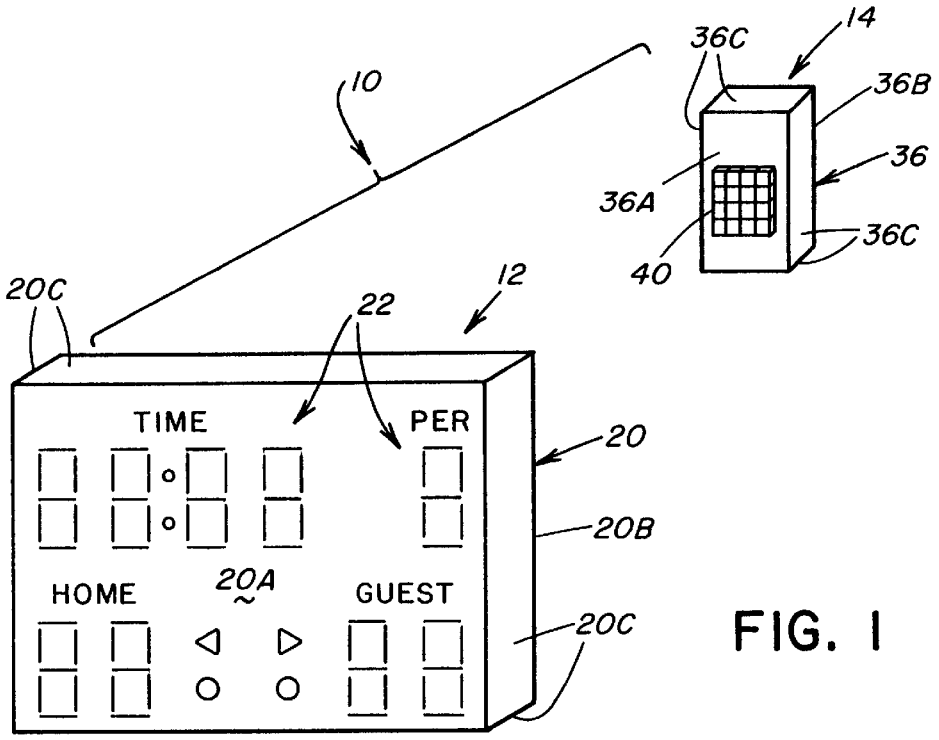
FIG. 1 is a perspective view of a portable scoreboard system of the present invention.
Figure 3:
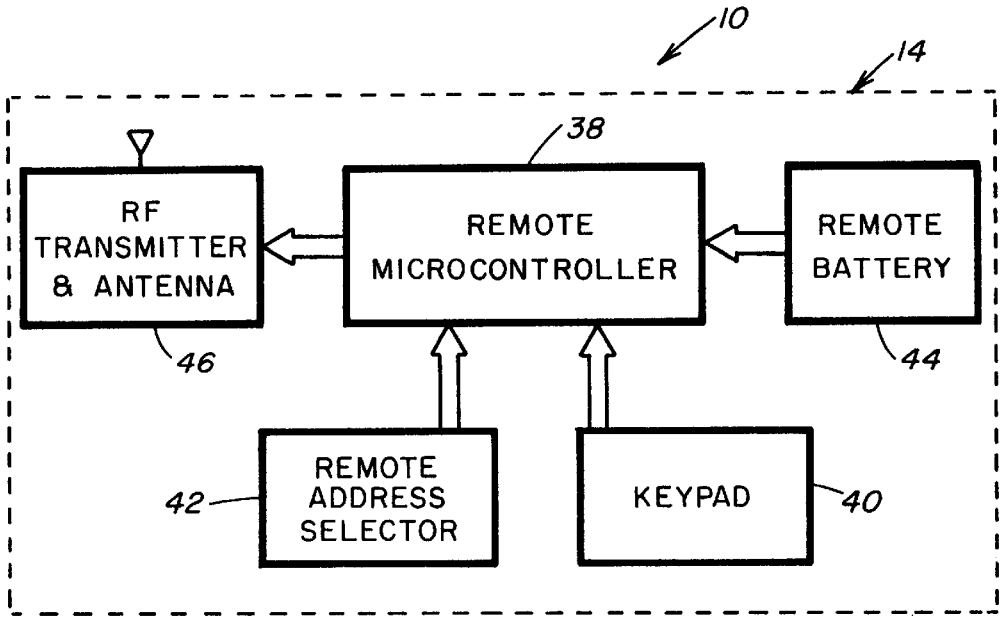
FIG. 3 is a block diagram of a remote control device of the portable scoreboard system.
Figure 2:
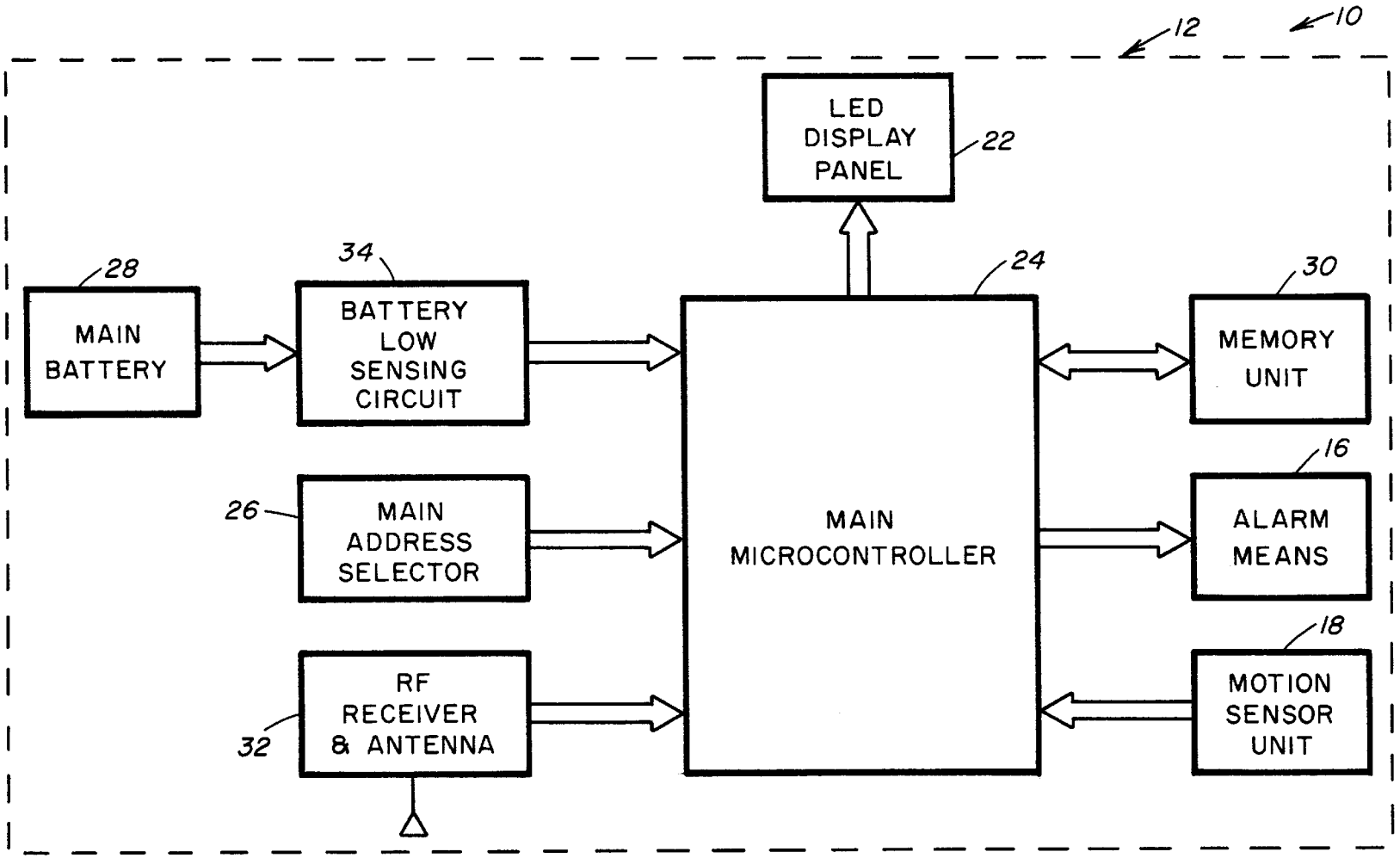
FIG. 2 is a block diagram of a main scoreboard of the portable scoreboard system.

Referring to FIGS. 1–3 of the drawings, there is illustrated a portable scoreboard system, generally designated 10, of the present invention having a motion sensing capability to provide protection against theft. Basically, the portable scoreboard system 10 comprises a main scoreboard 12 and a remote control device 14. The main scoreboard 12 is operable for displaying one or more scores and has alarm means 16 operable for generating an alerting output and a motion sensor unit 18 operable in response to movement of the main scoreboard 12 to cause the alarm means 16 to generate the alerting output that will warn the user of a possible impending theft attempt. The remote control device 14 is operable for controlling operation of the main scoreboard 12 and the motion sensor unit 18.

Referring now to FIGS. 1 and 2, in addition to the motion sensor unit 18 and alarm means 16 the main scoreboard 12 includes a scoreboard housing 20, a display panel 22, a main microcontroller 24, a main address selector 26, a main source of power such as one or more batteries 28, a memory unit such as non-volatile EEPROM member 30 and an RF receiver and antenna 32. Also, the main scoreboard 12 can have a battery low sensing circuit 34. The remote control 14 basically includes a casing 36, a remote microcontroller 38, a data entering means such as a keypad 40, a remote address selector 42, a remote source of power such as one or more batteries 44, and an RF transmitter and antenna 46.

The housing 20 of the main scoreboard 12 has opposite front and rear walls 20A, 20B and sidewalls 20C extending between and interconnecting the front and rear walls 20A, 20B so as to provide the housing 20 with a substantially rectangular box-like configuration, although the housing 20 may have any other suitable shape. The front wall 20A is the display side of the main scoreboard 12 whereas the rear wall 20B does not display any features of the main scoreboard 12. The scoreboard housing 20 may have any suitable size, but preferably it has a maximum height of about 23 inches, a maximum length of about 20.5 inches and a maximum depth of about 4.25 inches. The housing 20 is preferably comprised of a substantially rigid plastic material, though may be comprised of any other suitable material. The rigid plastic material is a high impact type and yet is also lightweight and water resistant. The main scoreboard 12 preferably has an assembled weight of about 15 pounds.

The display panel 22 of the main scoreboard 12 is mounted to the front wall 20A of the scoreboard housing 20 and particularly such that the display panel 22 is visible on the front wall 20A of the housing 20. Preferably, the display panel 22 is a LED type display and is substantially smaller in size than the scoreboard housing 2. The LED display panel 22 is preferably disposed closer to a top one of the side walls 20C than to a bottom one thereof. The display panel 22 also is spaced inwardly from opposite vertical side walls 20C of the scoreboard housing 20. The LED display panel 22 is configured to depict predetermined parameters of one or more sporting events. Preferably, the LED display panel 22 is a high intensity type and has a high efficiency driver circuit. Further, the LED display panel 22 has a first legend to identify predetermined parameters of a baseball game. For example, the parameters of a baseball game may include HOME, GUEST, BALLS, STRIKES, OUTS and INN, but are not so limited. The LED display panel 22 also has a second legend to identify predetermined parameters of sporting events other than a baseball game, such as football, basketball and soccer. For example, the parameters of events other than a baseball game may include HOME, GUEST, TIME, BONUS, POSSESSION and PERIOD, but are not so limited. The legends combined may have dedicated parameters for up to ten different sports, but are not so limited.

The main microcontroller 24 of the main scoreboard 12 is mounted to the scoreboard housing 20 and connected to the display panel 22. The main microcontroller 24 is disposed and enclosed within the housing 20. The main microcontroller 24 also is connected to the display panel 22 and operable to control and determine the parameters of the sporting event shown on the display panel 22. The main microcontroller 24 per se is any suitable conventional type, but should have a minimum read-only memory (ROM) of 8 K bytes and a minimum random access memory (RAM) of 128 K bytes. The main microcontroller 24 also may 1 K bytes EEPROM for storage of display settings prior to shutdown.

The main address selector 26 of the main scoreboard 12 is mounted to the housing 20 and particularly such that the first address selector 26 is accessible to the user on the front wall 20A of the housing 20. The first address selector 26 is connected to the main microcontroller 24 and preferably is in the form of a switch or the like actuatable by a user for selecting a predetermined sporting event. Upon the user making a selection, the first address selector 26 sends a predetermined signal to the main microcontroller 24. The first address selector 26 may have any suitable size and configuration.

The main source of power 28 of the main scoreboard 12 is mounted to the housing 20. The main source of power 28 is a d.c. battery 28 disposed and enclosed within the housing 20. The d.c. battery 28 connects to and powers the main microcontroller 24 as well as other components of the main scoreboard 12 via the main microcontroller 24. Preferably, the main source of power is a rechargeable 12 V lead acid battery 28, though may be any other suitable type of power source.

The memory unit 30 of the main scoreboard 12 is mounted to the scoreboard housing 20 and is disposed and enclosed therewithin. The memory unit 30 stores the predetermined parameters of one or more sporting events and is connected in communication with the main microcontroller 20. The memory unit 30 can includes the ROM, RAM and EEPROM of the main microcontroller 24. The memory unit 30 per se is any suitable conventional type.

The previously-mentioned motion sensor unit 18 is mounted to the housing 20 and is disposed and enclosed therewithin. The motion sensor unit 18 is responsive to movement of the scoreboard housing 20 and sends an activation signal, upon detection of movement, to the main microcontroller 24. The motion sensor unit 18 per se is any suitable conventional type, such as LDT Series from AMP Incorporated.

The alarm generating means 16 of the main scoreboard 12 is mounted to the scoreboard housing 20 and disposed and enclosed therewithin. The alarm generating means 16 preferably includes a speaker 48 operated by the main microcontroller 24 to emit the alerting output upon the main microcontroller 24 receiving the activation signal from the motion sensor unit 18. Furthermore, the speaker 48 is operated by the main microcontroller 24 for sounding beeps and sirens signaling predetermined aspects of one or more sporting events and for sounding an alerting output signal upon the main microcontroller 24 receiving a signal from the motion detector unit 18 that the main scoreboard 12 has been moved. The speaker 48 per se can be any suitable conventional type. The sound intensity preferably will exceed 90 db at a distance of 2 feet and be audible at a distance of 200 feet during the day. There are two audio default sounds, a beep and a siren. The beep is a brief tone which lasts for approximately 200 ms. The siren is of a frequency which varies from a minimum to a maximum in approximately 500 ms for a duration of 5 seconds. Beeps are used to indicate the expiration of time-out periods and to indicate when the motion sensor unit 18 is activated and deactivated. Two beeps indicate the motion sensor unit 18 is activated. One beep indicates the motion sensor unit 18 is deactivated.

The RF receiver and antenna 32 of the main scoreboard 12 are mounted to the scoreboard housing 20 and connected to the main microcontroller 24 of the main scoreboard 12 for receiving instruction and control signals from the remote control device 14 and for communicating the signals to the main microcontroller 24. The RF receiver and antenna 32 are sensitive to signals transmitted from a distance of at least 200 feet. The RF receiver and antenna 32 may be set by a switch, such as a PCB-mounted, four-position DIP switch (not shown), which shall allow a user to configure the RF receiver and antenna 32 for receiving signals from a particular transmitter. An established coding sequence is employed to allow the RF receiver and antenna 32 to reliably decode signals received. The RF receiver and antenna 32 per se is any suitable conventional type.

The battery low sensing circuit 34 of the main scoreboard 12 is mounted to the first housing 16 and connected in communication between main battery 28 and the main microcontroller 24 for indicating when power available in the battery 28 is low. The battery low sensing circuit 34 has a dedicated LED (not shown) to alert the user of the presence of a low battery condition. This LED preferably flashes at a ½ Hz rate when the battery potential drops below 11.5 V or thereabout. The LED display panel 22 shuts down when the battery 28 drops to 10.5 V or thereabout. A battery recharging means of any suitable type may be provided with the system 10.

The main scoreboard 12 may includes a handle (not shown) mounted to the scoreboard housing 20 for gripping and transporting the main scoreboard 12 by a hand of a user. The handle may be adjustable to fit any size of hand. The main scoreboard 12 may also include a movable cover (not shown) for use in protecting the display panel 22 during transport. The cover preferably will be transparent so that it can be deployed while the main scoreboard 12 is being used.

Turning to FIGS. 1 and 3, the casing 36 of the remote control device 14 has opposite front and rear faces 36A, 36B and side faces 36C which extend between and interconnect the front and rear faces 36A, 36B so as to provide the casing 36 with a substantially rectangular box-like configuration, although the casing 36 may have any other suitable shape. The front side 36A is the control side of the remote control device 14 and may have may have a label thereon (not shown) which identifies its functions. The casing 36 has a hand-holdable size, but may have any suitable size, with preferably a maximum height of 5.75 inches, a maximum length of 2.75 inches and a maximum depth of 0.875 inches. The casing 36 preferably is comprised of a substantially rigid plastic material, though may be comprised of any other suitable material. The rigid plastic material is a high impact type and yet is also lightweight and water resistant. The remote control device 14 preferably has an assembled weight of about 1 pound.

The remote microcontroller 38 of the remote control device 14 is mounted to the casing 36 and is disposed and enclosed therewithin. The remote microcontroller 38 is operable for generating output signals for instructing the main microcontroller 24 in determining which of the parameters of sports events are displayed on the LED display panel 22 of the main scoreboard 12. The remote microcontroller 38 is per se any suitable conventional type.

The keypad 40 of the remote control device 14 is mounted to the casing 36 at the front side 36A thereof and connected in communication with the remote microcontroller 38. The keypad 40 provides an arrangement of keys (not shown) for the user to use by depressing the keys to enter and send instructions and control signals to the remote microcontroller 38. Such signals concerns information related to the parameters of the selected sporting event to the second microcontroller 38 and the controlling of the parameters to be displayed on the LED display panel 22 of the main scoreboard 12. The keypad 40 preferably has at least fifteen keys, but may have any other suitable number of keys. By way of an example, the keys can be labeled with terms including SPORT, START, HOME, GUEST, PER/INN, DOWN, UP/STRIKES, TIME OUT, SIREN, SECURITY, TIMER ST/SP, RECALL, TIMER SET/BALLS, POSS/OUTS and BONUS. One or more or all of these keys may be incremental in that each press advances an indicator or digit to the next selection. Other keys may be like switches in that they switch between two alternatives, such as enable and disable, on successive presses. The SECURITY key is used (pressed) to enable (activate) and disable (deactivate) the motion detector unit 18 in the main scoreboard 12. As mentioned above, two beeps will sound to indicate that the motion detector unit 18 is enabled, whereas one beep will sound to indicate that it is disabled. Sirens are used to indicate when the game timer reaches zero, when the SIREN key is selected (pressed), and when the main scoreboard 12 is disturbed. The SIREN key on the keypad 40 is used (pressed) to arm and disarm the siren sound.

The remote address selector 42 of the remote control device 14 is mounted to the casing 36 and particularly such that the remote address selector 42 is accessible to the user on the front face 36A of the casing 36. The remote address selector 42 is connected to the remote microcontroller 38 and preferably is in the form of a switch similar to the main address selector 26 of the main scoreboard 12 or the like and is actuatable by the user for selecting a predetermined sporting event. Upon the user making a selection, the remote address selector 42 sends a predetermined signal to the remote microcontroller 38. The remote address selector 42 may have any suitable size and configuration.

The remote source of power, the battery 44, of the remote control device 14 is mounted to the casing 36 and is disposed and enclosed therewithin. The battery 44 is connected to the remote microcontroller 38 for powering the same as well as other components of the remote control device 14 via the remote microcontroller 38. The battery 40 preferably is a pair of AA alkaline batteries, though may be any other suitable type of power source.

The RF transmitter and antenna 46 of the remote control device 14 is mounted to the casing 36 and connected with the remote microcontroller 38 for receiving the output signals generated from the remote microcontroller 38. In response to the output signals, the RF transmitter and antenna 46 transmits a remote signal to the RF receiver and antenna 32 of the main scoreboard 12. The RF receiver and antenna 32 of the main scoreboard 12 transmit the remote signal to the main microcontroller 24 of the main scoreboard 12 such that the main microcontroller 24 is thereby, in effect, operated from the keypad 40 of the remote control device 14 via the remote and main microcontrollers 38, 24. The RF transmitter and antenna 46 may be set by a switch, such as a PCB-mounted, four-position DIP switch (not shown), which shall allow a user to configure the RF transmitter and antenna 46 for selecting a unique address included in the RF transmission. This feature enables the main scoreboard 12 to respond to the remote control device 14. The RF transmitter and antenna 46 per se is a conventional type.

It should be realized that the particular models of components making up an implementation of the scoreboard system 10 are not critical to its operation. The components described are per se commercially-available and well-known to those of ordinary skill in the art and so need not be described in further detail. It is only necessary that the components selected for the implementation of the present invention provide the various functions of the system 10 described herein.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A portable scoreboard system, comprising:

(a) a main scoreboard operable for displaying a score and having alarm means operable for generating an alerting output and a motion sensor unit operable in response to movement of said main scoreboard to cause said alarm means to generate said alerting output; and (b) a remote control device for controlling operation of said main scoreboard and motion sensor unit.

2. The system of claim 1 wherein said main scoreboard includes:

a scoreboard housing;

a display panel mounted to said scoreboard housing and configured to show predetermined parameters of one or more sporting events; and a main microcontroller mounted to said scoreboard housing and connected to said display panel and being operable to control said parameters shown on said display panel.

3. The system of claim 2 wherein:

said motion sensor unit is mounted to said scoreboard housing and is responsive to movement of said scoreboard housing by sending an activation signal to said main microcontroller; and said alarm means is mounted to said scoreboard housing and operated by said main microcontroller to emit said alerting output upon said main microcontroller receiving said signal from said motion sensor unit.

4. The system of claim 1 wherein said main scoreboard further includes:

a main address selector mounted to said scoreboard housing for a user to select a predetermined sporting event by sending a predetermined signal to said main microcontroller;

a memory unit mounted to said scoreboard housing for storing said predetermined parameters of said one or more sporting events and connected in communication with said main microcontroller; and an RF receiver and antenna mounted to said scoreboard housing and connected to said main microcontroller for receiving control signals from said remote control device and communicating said control signals to said main microcontroller.

5. The system of claim 4 wherein said main scoreboard further includes a main source of power mounted to said scoreboard housing for powering said main microcontroller.

6. The system of claim 5 wherein said main source of power of said main scoreboard is a battery.

7. The system of claim 6 wherein said main scoreboard further includes a battery low sensing circuit mounted to said scoreboard housing and connected in communication between said battery and said main microcontroller for indicating when power available in said battery is low.

8. The system of claim 1 wherein said remote control device includes:

a casing;

a remote microcontroller mounted to said casing for generating output signals for instructing said main microcontroller in determining said parameters displayed on said display panel of said main scoreboard;

means mounted to said casing for entering information related to said parameters of a selected one of said sporting events in said remote microcontroller for determining said output signals generated by said remote microcontroller; and an RF transmitter and antenna mounted to said casing and connected to said remote microcontroller for receiving said output signals generated from said remote microcontroller and transmitting a remote signal to said RF receiver and antenna of said main scoreboard and therefrom to said main microcontroller of said main scoreboard such that said main microcontroller is thereby instructed in determining said parameters displayed on said display panel of said main scoreboard.

9. The system of claim 8 wherein said remote control device further includes a source of power mounted to said casing for powering said remote microcontroller.

10. The system of claim 9 wherein said source of power of said remote control device is a battery.

11. The system of claim 8 wherein said remote control device further includes a remote address selector mounted to said casing and connected to said remote microcontroller for a user to use to select a certain sporting event by sending a predetermined signal to said remote microcontroller.

12. The system of claim 8 wherein said entering means of said remote control device is a keypad connected in communication with said remote microcontroller for a user to use to send instruction and control signals to said remote microcontroller.

13. The system of claim 1 wherein a first portion of said display panel has a first legend to identify first predetermined parameters of a baseball game.

14. The system of claim 1 wherein a second portion of said display panel has a second legend to identify second predetermined parameters of sporting events other than a baseball game.

15. The system of claim 2 wherein said means is a speaker mounted to said scoreboard housing for sounding beeps and sirens signaling predetermined aspects of one or more sporting events and for sounding said alerting output upon said main microcontroller receiving an activating signal from said motion sensor unit.

16. A portable scoreboard system, comprising:

(a) a main scoreboard including (i) a scoreboard housing, (ii) a LED display panel mounted to said scoreboard housing and configured to show predetermined parameters of one or more sporting events, (iii) a main microcontroller mounted to said scoreboard housing and connected to said LED display panel and being operable to control said parameters shown on said LED display panel, (iv) a main address selector mounted to said scoreboard housing and connected to said main microcontroller for a user to use to select a predetermined sporting event by sending a signal to said main microcontroller, (v) a battery mounted to said scoreboard housing for powering said main microcontroller, (vi) a battery low sensing circuit mounted to said scoreboard housing and connected in communication between said battery and said main microcontroller for indicating when power available in said battery is low, (vii) a memory unit mounted to said scoreboard housing for storing said predetermined parameters of one or more sporting events and connected in communication with said main microcontroller, (viii) a motion sensor unit mounted to said scoreboard housing and being operable in response to movement of said scoreboard housing to send an activation signal to said main microcontroller, (ix) a speaker mounted to said scoreboard housing and operated by said main microcontroller to emit audible sounds signaling predetermined aspects of one or more sporting events and alarm sounds upon said main microcontroller receiving said activation signal from said motion sensor unit, and (x) an RF receiver and antenna mounted to said scoreboard housing and connected to said main microcontroller; and (b) a remote control including (i) a casing, (ii) a remote microcontroller mounted to said casing for generating output signals for instructing said main microcontroller in determining said parameters displayed on said LED display panel of said main scoreboard and for enabling and disabling said motion sensor unit, (iii) means mounted to said casing for entering information related to said parameters of a selected one of said sporting events to said microcontroller for determining said output signals generated by said remote microcontroller, (iv) a source of power mounted to said casing for powering said remote microcontroller, and (v) an RF transmitter and antenna mounted to said casing and connected to said remote microcontroller for receiving said output signals generated from said remote microcontroller and transmitting a remote signal to said RF receiver and antenna of said main scoreboard and therefore to said main microcontroller of said main scoreboard such that said main microcontroller is thereby instructed in determining said parameter displayed on said LED displayed panel of said main scoreboard by entering means of said remote control and in enabling or disabling said motion sensor unit.

17. The system of claim 16 wherein a first portion of said display panel has a first legend to identify first predetermined parameters of a baseball game.

18. The system of claim 17 wherein a second portion of said display panel has a second legend to identify second predetermined parameters of sporting events other than a baseball game.

19. The system of claim 16 wherein said remote control further includes a remote address selector mounted to said casing for a user to use to select a certain sporting event by sending a signal to said remote microcontroller.

20. The system of claim 16 wherein said entering means of said remote control device is a keypad connected in communication with said remote microcontroller for a user to use in sending instruction and control signal to said remote microcontroller.

* * * * *